United States Patent [19]

Reed et al.

[11] 4,297,094

[45] Oct. 27, 1981

[54] FREE-FLOATING COMBUSTION CHAMBER AND STACK

[75] Inventors: Robert D. Reed; Robert E. Schwartz; Raymond D. Kraft, all of Tulsa, Okla.

[73] Assignee: John Zink Company, Tulsa, Okla.

[21] Appl. No.: 122,274

[22] Filed: Feb. 19, 1980

[51] Int. Cl.[3] ..... F23D 13/20

[52] U.S. Cl. ..... 431/202; 110/336

[58] Field of Search ..... 431/202, 5; 110/336, 110/184

[56] References Cited

U.S. PATENT DOCUMENTS

| | | | |
|---|---|---|---|
| 3,933,420 | 1/1976 | Zink et al. | 431/202 |
| 4,065,247 | 12/1977 | Okigami et al. | 431/202 |
| 4,140,471 | 2/1979 | Straitz et al. | 431/202 X |

*Primary Examiner*—Edward G. Favors

*Attorney, Agent, or Firm*—Head & Johnson

[57] ABSTRACT

A burner-stack-furnace system comprising a stack of selected diameter and height, which is supported on a circular base ring, which is, itself, supported on a plurality of circularly positioned upright columns. The columns are supported on grade and are spaced equally circumferentially. The furnace or combustion section of the system is of the same diameter as the stack, and has a plurality of re-entrant vertical channels in its outer wall, spaced to surround each of the columns, with a selected air space between them. The combustion section thus hangs partly within the circle of the columns or piers, and partly between the piers. A shallow excavation is made below grade within and between the columns, and the combustion section extends downwardly into the excavation, which is deep enough that the bottom edge of the wall is above the base of the excavation. The combustion section is open on the bottom, but is filled with a porous fill of heat-resisting material, to a selected level. One or a plurality of circumferentially spaced openings in the wall of the combustion section are provided for combustion air and for gaseous or liquid fuel burners. In addition to the pipes which supply fuel to the burners, there are other pipes which supply either water or steam. The water is supplied through an atomizing nozzle, so that the droplets flow directly into the path of the fuel and into the flame.

8 Claims, 6 Drawing Figures

FREE-FLOATING COMBUSTION CHAMBER AND STACK

CROSS-REFERENCE TO RELATED APPLICATION

This Application is related to co-pending Application Ser. No. 939,474, filed Sept. 5, 1978, abandoned, entitled "STRUCTURAL SUPPORTS FOR FURNACE SECTIONS".

BACKGROUND OF THE INVENTION

1. Field of the Invention

The invention lies in the field of fluid fuel combustion systems. More particularly, it is concerned with furnace systems, which have a stack of substantial height and weight, and provides means for supporting the stack independently of the combustion section.

2. Description of the Prior Art

In the prior art, the stacks and combustion sections were generally of the same diameter, and the stack was supported integrally with the combustion section, which was, itself, supported on grade.

In view of the need for large areas of openings in the combustion section for the supply of combustion air, the structural strength of the combustion section wall is reduced to the point where there is danger of collapsing under the weight of the stack. To prevent collapse, extensive reinforcement of the wall of the combustion section is required. Thus, as a practical matter, the combustion section must be designed as a structural system rather than a combustion system.

SUMMARY OF THE INVENTION

It is a primary object of this invention to provide a structural support for a furnace that has a stack and a combustion section, by erecting a circle of spaced columns or piers standing on grade, and adapted to carry a circular support ring, on top of which is placed the stack, with the combustion section hung penduously from the support ring, inside of, and between the columns.

These and other objects are realized, and the limitations of the prior art are overcome in this invention by supporting the stack on a circular base ring, which is itself supported on a plurality of vertical piers or columns, positioned in a circular ring. The columns are set on grade, and can be constructed of concrete or steel, or in any desired manner.

The height of the columns which support the support ring, on which the stack is carried, is limited in relation to the total height of the columns plus the stack. Therefore, the vertical extent or height and volume of the combustion section is dependent on the height of the column.

The combustion chamber is nominally of the same diameter as the stack and has a plurality of reentrant vertical channels in the outer wall, which are spaced to correspond to the spacing of the columns. Thus, the combustion chamber hangs partly between the columns and partly inside the columns. These segments between the columns add a large cross-sectional area to the combustion zone over that of the prior art, where the combustion section hangs entirely within the piers.

It is desirable also to increase the height of the combustion section to a value greater than that of the columns. But, since it hangs from the support ring, the only way the height can be increased is by creating a shallow excavation between the inside of the piers, so that the combustion section can hang down inside of the excavation.

The combustion section, or furnace, does not have a closed bottom and the space inside the wall is filled to a selected depth, with a fill of heat resistant material, such as sand, gravel, or porous ceramic material, for example. The diameter of the excavation is greater than that of the furnace so that there will be sufficient clearance for the wall to expand and contract in accordance with the temperature inside the furnace. The outer wall also hangs so that its bottom edge is above the base of the excavation, so that combustion air can be drawn down outside of, and under the bottom edge of the wall, and up into the combustion chamber through the porous fill. This serves to provide additional combustion air, as well as to keep the fill material cool.

There are a plurality of circumferential openings in the outer wall of the combustion section, which are positioned symmetrically with regard to the columns. These openings are for the entry of combustion air, and also for fuel pipes and burners. Also, additional pipes may be provided for waste or steam to be injected into the flame for the purpose of improving the complete combustion of the gases. The water pipes have nozzles which provide a very fine spray of water droplets into the flame. If desired, the water spray can be injected into the fuel line. Alternatively, steam can be injected into the flame or into the fuel line to mix with the fuel prior to issuance into the combustion chamber.

BRIEF DESCRIPTION OF THE DRAWINGS

These and other objects and advantages of this invention, and a better understanding of the principles and details of the invention will be evident from the following description taken in conjunction with the appended drawings, in which.

DETAILED DESCRIPTION OF THE PREFERRED EMBODIMENT

Figure 2:
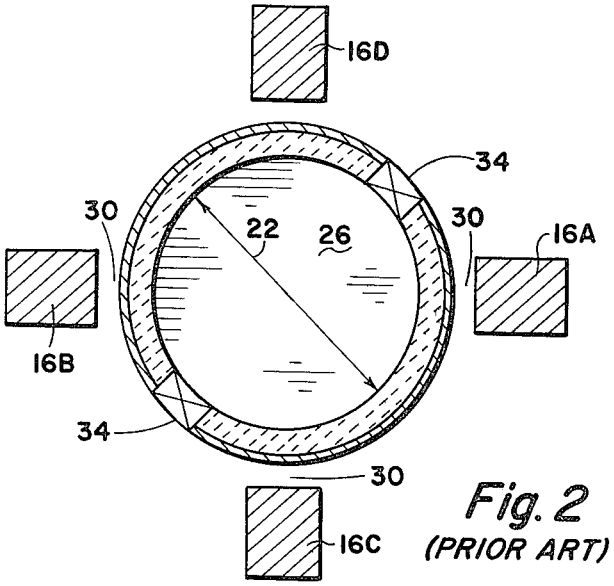
Fig. 2 (PRIOR ART)
FIGS. 1 and 2 show features of the prior art construction.
Figure 1:
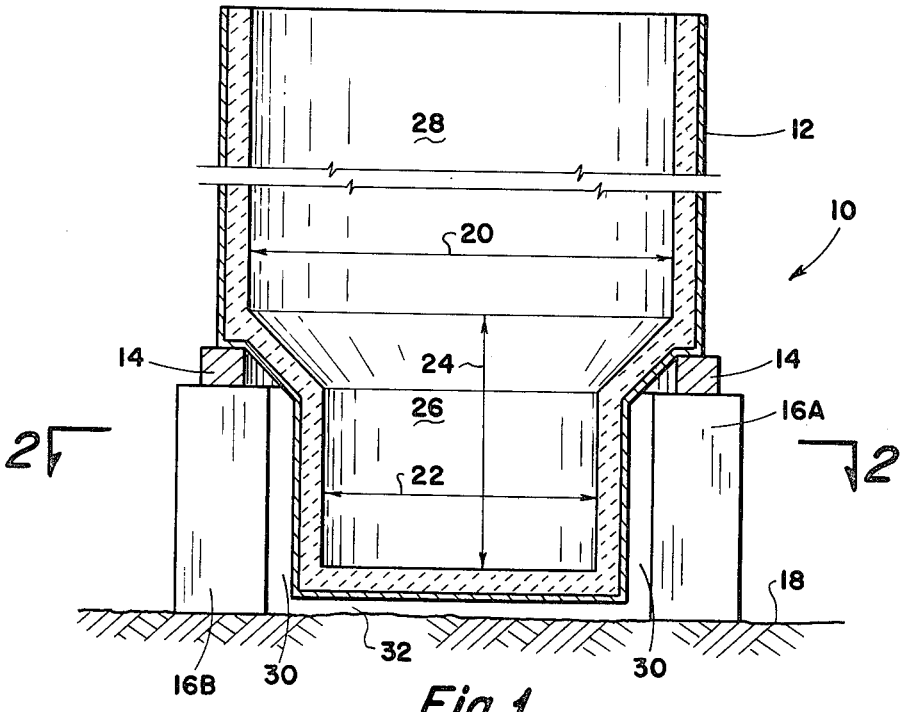
Fig. 1 (PRIOR ART)

Referring now to the drawings and, in particular, to FIGS. 1 and 2, there is shown the prior art type of construction, in which the combustion section, or furnace 21 is supported penduously from a support ring 14 and hangs entirely within the inner perimeter of the ring of columsn, or piers, 16A, 16B, 16C, and 16D. The combustion chamber 21 is suspended entirely within the circle of the piers, and is of lesser diameter 22 than that 20 of the stack 12. Also, because of the limitation in the height of the piers 16, which is dependent upon the total height of the piers plus the stack, additional combustion space 26 is required for the combustion chamber. This is provided in two ways, which are illustrated in FIGS. 3 and 4.

Figure 4:
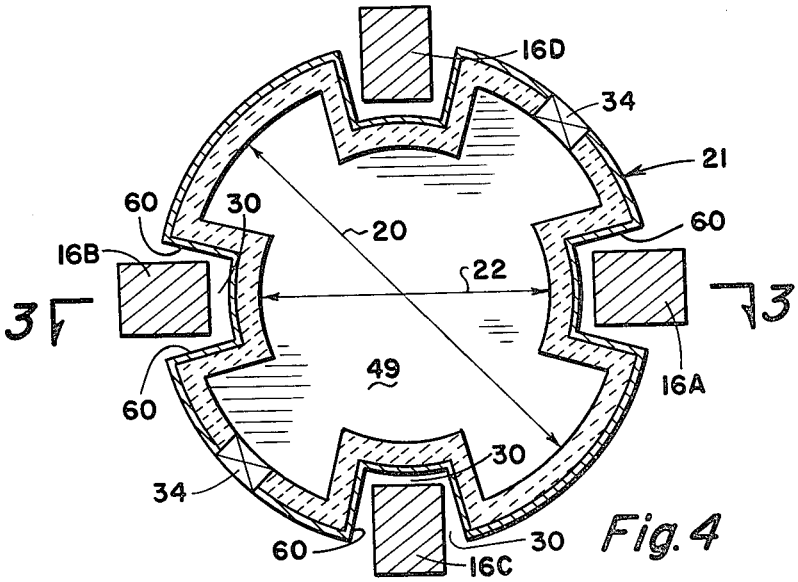
FIG. 4 shows a horizontal cross-section, taken across the plane 4—4 of FIG. 3.
Figure 3:
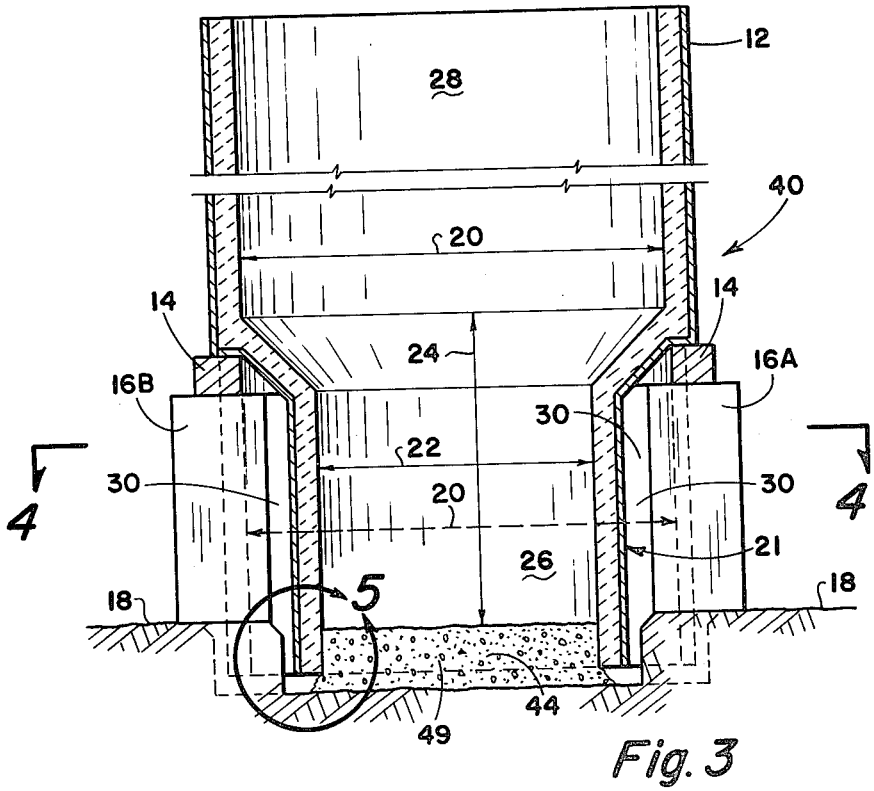
FIG. 3 shows a diametral vertical cross-section of the system of this invention taken across plane 3—3 of FIG. 4.

FIG. 3 is a vertical cross-section taken along the plane 3—3 of FIG. 4 and identifies the structure by the general numeral 40. The construction comprises a group of piers or columns 16A, 16B, 16C, and 16D, which are arranged in a circle of such diameter that they can support a circular base ring 14 which rests on the top of the columns. The base ring is of such diameter as to fully support the weight and provide stability for the stack 12. The stack is of conventional construction, which provides a circular cylindrical outer wall 21 and has ceramic insulation material inside, suitable to the temperatures that will be provided in the space 28 inside of the stack, as the hot gases from the furnace rise to be expelled at the top of the stack into the atmosphere.

The colums 16 rest on grade 18 and are limited in their height in relation to the overall height of the columns, plus the support ring, plus the stack. The combustion chamber indicated generally by the numeral 21 hangs penduously from the base ring 14, which supports the stack. Thus, the stability of the stack depends only on the columns and is independent of the combustion section. This is contrary to the normal construction, in which the stack rests entirely on the combustion section. As more and more openings 34 are provided in the wall of the combustion section, the structural strength of the combustion section becomes less and less, and the design of the combustion section becomes more structural than thermal. The improved construction of our invention separates the structural requirement from the thermal requirements of the combustion section.

As shown in FIG. 4, the cross-section of the combustion section 21 has an outer nominal diameter which is equal to that of the cross-section of the stack, with a plurality of reentrant vertical channels in the wall of the combustion section, identified by the numerals 60. These channels are spaced such as to be symmetrical with respect to the columns, and to provide a suitable air space 30 between the columns and the wall of the combustion section, for the purpose of cooling the structural columns. Air circulation through the spaces 30 will be provided by the heating of the air in the spaces 30, which consequently rises to be replaced by cool air entering the channels in the lower region and moving upwardly.

A comparison of FIGS. 2 and 4 will indicate the particular advantage of the construction of FIG. 4 over that of FIG. 2, namely, that the diameter of the combustion chamber is not limited to the dimension 22 but has sectors having a larger diameter of dimension 20. Thus, a much larger cross-sectional area of a combustion zone is provided by the design of FIGS. 3 and 4 over those of FIGS. 1 and 2.

Figure 5:
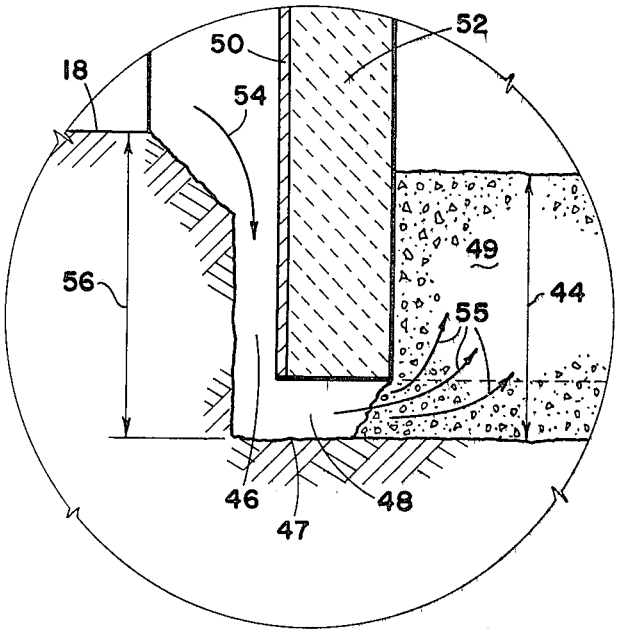
FIG. 5 illustrates a detail 5—5 of FIG. 3.

The volume of the combustion zone is increased in another way as shown in FIGS. 3 and 5. This is by means of an increase in vertical height of the combustion zone. In FIG. 1 and in the priot art, while the combustion section hangs entirely within the ring of columns, the bottom has been shown as being closed, with suitable ceramic insulation, and is supported a suitable distance 32 above grade.

In FIG. 3 the improvement of this invention is shown as a shallow excavation of depth 56 below grade, and of outer contour which is somewhat larger than the outer contour of the combustion section as shown in FIG. 4. The purpose of the excavation is to permit a design in which the combustion chamber height 24 is considerably greater than that of the prior art installations. The bottom of the combustion chamber is open and the internal space is filled with porous material 49 to a height 44. The porous material can be sand, gravel, ceramic, etc.

FIG. 5 shows a detail of the construction of the excavation. The vertical extent of the excavation is indicated by dimension 56. The outer steel wall 50 of the combustion zone and the internal insulation covering 52, are somwhat shorter, and hang a suitable distance 48 above the base 47 of the excavation. This provides an air space 48 so that cool air can flow in accordance with arrow 54 down through the space 46 outside of the combustion chamber wall, and under the wall 50 through space 48, and up through the porous material 49 in accordance with arrows 55. This flow of cool air upwardly through the fill 49 inside of the combustion chamber serves not only to provide additional combustion air, but also to provide cooling for the porous material. Thus, as indicated in FIGS. 3, 4, and 5, the improved construction of this invention serves to provide a considerably larger volume of combustion space 26 inside of the combustion chamber.

Most of the combustible waste gases or liquids which are to be burned in the flare are smoke-prone, and smoky burning is environmentally unacceptable, if any smoke escapes, visibly, to the atmosphere. Smoke is carbon particles which have escaped from the combustion zone where carbon, hydrogen, and other elements provide the composition of the waste matter. In most cases it is possible to secure complete burning of waste—that is, the avoidance of smoke, through retention of carbon within the combustion chamber-stack structure, at sufficiently high temperature, long enough for the carbon to oxidize. In that case, no visible smoke emerges to the atmosphere.

Since waste matter for disposal by burning can vary widely, as to smoking tendency, a system which is satisfactory for smokeless operations with a great majority of waste materials, may still deliver visible smoke when a very few smoke-prone materials are being burned. This would require the elimination of smoke even for these very few materials which are only burned on rare occasions.

At temperature above ignition temperature, carbon can oxidize in a number of ways, such as:

$$C+\tfrac{1}{2}O_2=CO$$

$$C+O_2=CO_2$$

$$C+H_2O=CO+H_2$$

$$C+2H_2O=CO_2+2H_2$$

The first two reactions shown are typical of oxidation of carbon, at adequate temperature level, by oxygen alone. The second two represent the attack of water-vapor and are typical "water-gas shift" reactions which are well-known in industry. Greater partial-pressure of water vapor in an atmosphere greatly accelerates the water-gas shift reactions when the temperature is adequate, as it is in a combustion zone. Also, when water-spray is introduced to a combustion zone it immediately is evaporated to become water vapor, rather than droplets of water liquid, to add to water vapor partial-pressure in the combustion zone. The water vapor effect is to greatly accelerate carbon oxidation. The CO and $H_2$ produced burn by direct oxidation with tremendous speed, and in an assured manner, and cannot be seen.

When it is necessary for avoidance of smoke emission, we take advantage of the water-gas chemistries through injection of water spray from at least one water spray nozzle to the combustion zone. It is clear that the spray is not constantly required but is used for smoke-prone wastes normally. However, use of water spray with all burning will allow a smaller (less expensive) combustion chamber-stack system, to provide satisfactorily smokeless operation constantly in many waste disposal problems. The total internal volume of the combustion chamber-stack can be less because of the greatly accelerated carbon oxidation as discussed. Of course, steam can be used in place of water for injection into the flames. However, because of its cost, steam would be a second choice.

Figure 6:
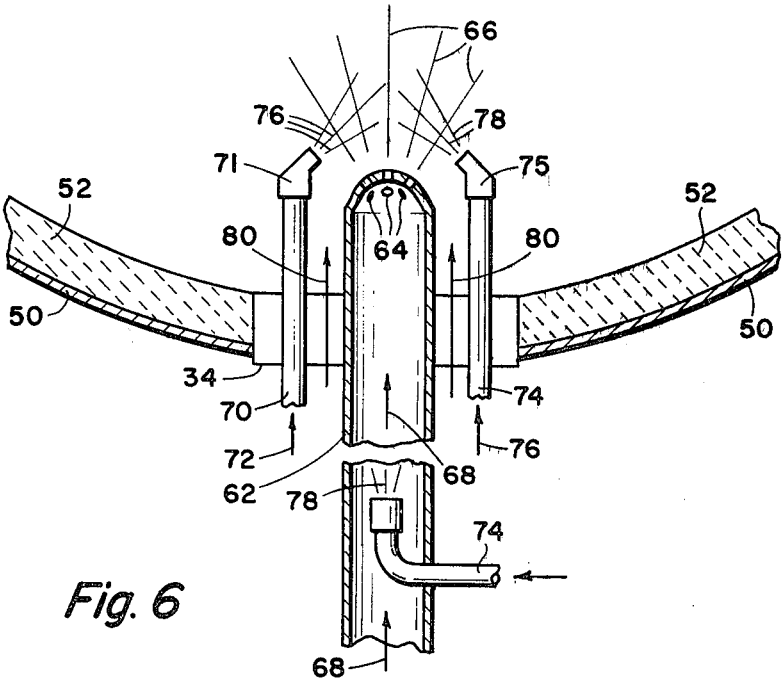
FIG. 6 illustrates the burners, and water of steam pipes, that may be utilized in one or more of the openings in the wall of the combustion chamber, in addition to the space provided for entry of combustion air.

Referring now to FIG. 6, one example is shown of the possible arrangement of fuel pipes and water and/or steam pipes, inserted into an opening 34 in the wall of the combustion section. Although any type of fuel burner can be used, the illustration shows a gas burner 62, having a nozzle with ports 64. Gas is supplied in accordance with arrow 68 from a suitable source through the pipe 62 and issues as high speed jets 66 from the ports 64. The pipe 70 is illustrated as a possible water pipe, which has a nozzle 71, and water supplied in accordance with arrow 72. Water will issue through the orifices as jets of tiny droplets of water which would be injected into the flow of gas issuing from the ports 64 in accordance with the spray 66.

Alternatively, pipe 74 is shown which has a suitable flow of steam in accordance with arrow 76, and has a nozzle 75 with suitable ports that provide a series of jets 78 of steam, which are injected into the flow of gas 66. For gaseous fuel, the water droplets or the steam can be injected alternatively in accordance with the pipe 74 with suitable nozzles and ports to provide spray 78 into the main flow of gas, so that initimate mixing of the water droplets with the fuel will provide intimate contact with the water vapor resulting from evaporation of the droplets as the gas and water are injected into the flame. Thus, the suitable burning chemistry is provided. The openings 34 are much larger than would be needed simply for the piping, so that there is adequate area for flow of combustion air, as shown by arrows 80 in FIG. 6. Also, openings can be provided solely for air, as needed.

In further clarification of the combustion chamber-stack volumetric relationship, both the stack 28 and the combustion chamber 26 volumes combine to provide a total volume, within which there is to be complete burning of waste matter. But the chemical reactions of combustion are almost infinitely more rapid in the high temperature turbulent combustion chamber than they are in the diffusive (unturbulent) lower temperature stack gas flow. For this reason, and if emission of smoke is to be avoided, a vast majority of the combustion chemical reactions must have been completed before emergence of continued burning from the combustion chamber internal volume 26 to the stack internal volume 28. The combustion chamber turbulence is burner-created, and the internal volume of the combustion-chamber determines how soon, or how rapidly, the burning will depart from the combustion chamber, and enter the non-turbulent stack. Thus, there is need for all the combustion chamber volume which is possible within structural limits.

While this invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element or step thereof is entitled.

What is claimed is:

1. An improved structure for a burner-stack-furnace system comprising:

(a) a horizontal base ring of selected horizontal shape and size;

(b) a vertical stack of selected height, and of horizontal shape and size related to said base ring, attached to and supported on said base ring;

(c) a plurality of circumferentially-spaced support columns of selected height arranged in a ring of shape and size to receive and support said base ring;

(d) a combustion section of substantially the same size and shape in cross-section as said stack, and including a plurality of re-entrant vertical channels in the outer wall of said combustion section, one positioned at each of the positions of said support columns, the dimensions of said channels such as to provide air space between said columns and said outer wall; said combustion section penduously supported from said support ring;

(e) said combustion section having at least one opening through its circumferential wall in the spaces between columns, for the insertion of at least one fuel burner.

2. The furnace systems as in claim 1, and including:

(a) a shallow excavation below grade level; inside said ring of columns and between said columns, slightly larger in cross-section than said combustion section;

(b) said excavation of selected depth;

(c) the height of said combustion chamber greater than the height of said support ring above grade;

whereby said combustion section will be supported penduously from said base ring out of contact with the earth inside of said excavation.

3. The furnace system as in claim 2 in which:

(a) the bottom of said combustion section is open; and (b) the space inside of the wall of said combustion section is filled to a selected level with a heat resistant porous fill, such as sand, gravel, or crushed refractory material, whereby combustion air can flow downwardly into said excavation, outside of the wall of said combustion section, under the bottom edge of said wall, and upwardly into said combustion section through said porous fill; to cool said fill and to provide additonal combustion air.

4. The furnace system as in claim 1, and including:

at least one means to spray atomized water droplets into said combustion section in the vicinity of said fuel burner.

5. The furnace system as in claim 1, in which said fuel is gaseous, and including:

means to spray atomized water droplets into the gas line upstream of said burner.

6. The furnace system as in claim 1, and including:

means to inject steam into said combustion section.

7. The furnace as in claim 1 in which said combustion section has a plurality of spaced openings, each positioned in one of the circumferential spaces between the columns.

8. The furnace as in claim 1 in which the cross-sectional shapes of said support ring, said stack, and said combustion section are all circular.

* * * * *